US009523237B2

(12) United States Patent
Lauterjung et al.

(10) Patent No.: US 9,523,237 B2
(45) Date of Patent: Dec. 20, 2016

(54) AERIAL SYSTEM, IN PARTICULAR TURNTABLE LADDER SYSTEM

(71) Applicant: Iveco Magirus AG, Ulm (DE)

(72) Inventors: Christoph Lauterjung, Ulm (DE); Rene Peper, Neu-Ulm (DE)

(73) Assignee: Iveco Magirus AG, Ulm (DE)

( * ) Notice: Subject to any disclaimer, the term of this patent is extended or adjusted under 35 U.S.C. 154(b) by 0 days.

(21) Appl. No.: 14/247,990

(22) Filed: Apr. 8, 2014

(65) Prior Publication Data

US 2014/0305738 A1 Oct. 16, 2014

(30) Foreign Application Priority Data

Apr. 10, 2013 (EP) ..... 13163117

(51) Int. Cl.

| | |
|---|---|
| ***B66F 11/04*** | (2006.01) |
| ***A62C 27/00*** | (2006.01) |
| ***E06C 5/32*** | (2006.01) |
| ***B66F 17/00*** | (2006.01) |
| ***E06C 5/04*** | (2006.01) |
| *B66C 13/54* | (2006.01) |

(52) U.S. Cl.

CPC ..... *E06C 5/32* (2013.01); *B66F 11/04* (2013.01); *B66F 17/006* (2013.01); *E06C 5/04* (2013.01); *A62C 27/00* (2013.01); *B66C 13/54* (2013.01)

(58) Field of Classification Search

CPC ..... B66F 11/04; B66F 9/20; B66F 11/046; B66F 11/042; B66F 11/044; B66F 17/00; B66F 17/006; A62C 27/00; E06C 5/04

See application file for complete search history.

(56) References Cited

U.S. PATENT DOCUMENTS

| | | | | | |
|---|---|---|---|---|---|
| 2,841,960 | A | * | 7/1958 | Holan et al. | 91/529 |
| 2,951,549 | A | * | 9/1960 | Holan | E06C 5/18 182/208 |
| 3,262,517 | A | * | 7/1966 | Malec | B66F 11/046 182/127 |
| 3,498,474 | A | * | 3/1970 | Pierce, Jr. | B66F 11/044 182/141 |
| 3,625,307 | A | * | 12/1971 | Siefermann | E06C 5/04 182/2.11 |
| 3,882,963 | A | * | 5/1975 | Ashworth | E06C 5/04 182/127 |

(Continued)

FOREIGN PATENT DOCUMENTS

| | | | | |
|---|---|---|---|---|
| CN | 1237464 | | 12/1999 | |
| DE | 9416367 | * | 12/1994 | B66F 11/04 |

(Continued)

*Primary Examiner* — Daniel Cahn

(74) *Attorney, Agent, or Firm* — Stetina Brunda Garred and Brucker

(57) ABSTRACT

Disclosed is a turntable ladder system mounted on a rescue vehicle. The system includes a turntable ladder mounted on top of a rescue vehicle and comprising an arm that can be bent downwardly to the ground in front of the driver's cabin of the vehicle, and an operator stand located at the ladder for operating the ladder. The operator stand includes a control for controlling movement of the arm. This turntable ladder system also includes a manually operable confirmation button located on the driver's cabin. The confirmation button is operatively connected to the control such that the bending movement of the arm can be controlled by the control only if the confirmation button is operated.

9 Claims, 2 Drawing Sheets

(56) References Cited

U.S. PATENT DOCUMENTS 4,461,369 A * 7/1984 Amador ..... E01D 19/106 182/2.6
4,646,875 A * 3/1987 Sholl ..... E01D 19/106 182/2.6
5,029,532 A * 7/1991 Snead ..... 105/239
6,439,408 B1 * 8/2002 Aquino ..... B66C 13/54 212/227
6,543,578 B1 * 4/2003 Merz ..... B66C 13/56 182/148
6,811,161 B1 * 11/2004 Anderson ..... 280/4
2004/0085184 A1 * 5/2004 Sigmund ..... 340/3.42
2004/0149520 A1 * 8/2004 Taylor et al. ..... 187/203
2004/0262078 A1 * 12/2004 Bailey ..... B66F 17/006 182/2.1
2009/0145871 A1 * 6/2009 Bond ..... B66F 11/046 212/285
2009/0260920 A1 * 10/2009 Cummings ..... B66F 11/046 182/18
2010/0140016 A1 * 6/2010 Raappana ..... B66F 11/046 182/20
2011/0038691 A1 * 2/2011 Leske ..... 414/139.5
2012/0048205 A1 * 3/2012 Sia ..... 119/437
2012/0318610 A1 * 12/2012 Cummings ..... B66F 9/24 182/18
2013/0313040 A1 * 11/2013 Cummings ..... B66F 11/046 182/18
2014/0262593 A1 * 9/2014 Castaneda et al. ..... 180/446
2015/0120152 A1 * 4/2015 Lauterjung ..... E06C 5/18 701/49

FOREIGN PATENT DOCUMENTS

EP 0579181 1/1994
EP 0867595 9/1998

* cited by examiner

AERIAL SYSTEM, IN PARTICULAR TURNTABLE LADDER SYSTEM

CROSS REFERENCE TO RELATED APPLICATIONS

The present application claims priority to European Patent Application No. 13163117.8 filed Apr. 10, 2013.

STATEMENT RE: FEDERALLY SPONSORED RESEARCH/DEVELOPMENT

Not Applicable.

BACKGROUND OF THE INVENTION

Field of the Invention

The present invention refers to an aerial system, in particular a turntable ladder system, according to the preamble of claim 1.

State of the Art

Turntable ladder systems are mounted on top of rescue vehicles, especially fire fighting vehicles. Turntable ladder systems represent one type of aerial system that is equipped with a telescopic ladder, and although the following description may refer to aspects of turntable ladders, the present invention is applicable to other aerial systems comprising extendable ladders or telescopic arms that can be extended to reach remote points at great heights. To further improve the flexibility of such ladders, an articulated arm is added at their end that can be bent downwardly. By this construction it is possible to move the end of the ladder down to the ground to facilitate the access to the ladder, in particular to a cage that may be mounted to the ladder end. This means that the ladder may be accessed not only from the deck of the rescue vehicle but also from the ground in the vicinity of the vehicle.

Preferably, the end of the arm may be lowered while the ladder is in any position, including bending down the arm to the ground in front of the driver's cabin, which will be designated as "bending movement" in the following for the sake of simplicity. Usually the movement of the ladder is controlled from a main operator stand that is located at the base of the ladder, or near its turning axis on top of the vehicle. In this case the driver's cabin blocks the view of the ladder operator so that it is impossible to monitor the ground area in front of the vehicle where the end of the arm shall be positioned during and after the aforesaid bending movement. For this reason, organizations have placed severe administrative restrictions on the operation of such ladders, forbidding movements of ladder parts in areas that cannot directly be monitored from the main operator stand. Under all circumstances injury to any persons present in the area in front of the driver's cabin which could be hurt by a collision with the arm, or objects with which the arm could collide must be avoided.

A similar problem arises when the bending movement of the ladder is operated from an auxiliary operator stand that can be located in a cage at the end of the ladder. The operator of this auxiliary operator stand may not be able to monitor the ground area completely, and there might be obstacles or persons beneath the cage or at his back that can collide with the cage.

SUMMARY OF THE INVENTION

It is therefore an object of the present invention to provide an aerial system of the above kind that allows a safe lowering operation of the articulated arm. Specifically, for the arm to be bent safely to the ground in front of the driver's cabin of the vehicle, without the danger of any collision with persons or objects that are potentially present in this area. A general object is to improve the security of operation of such aerial systems.

This object is achieved by an aerial system comprising the features of claim 1.

The aerial system according to the present invention comprises a confirmation means that is located at the front of or laterally at the driver's cabin. This confirmation means is manually operable by a person monitoring the area in front of the driver's cabin. The confirmation means is operatively connected to the control means of the operator stand such that the above described bending movement of the arm can be controlled by the control means only in case the confirmation means is operated.

In this system control of the ladder to bend the arm downwardly to the ground in front of the driver's cabin is possible from the operator stand only if the confirmation means is operated by an auxiliary person. Without this confirmation, it is impossible to initiate this bending movement. However, with the confirmation means being operated, the ladder operator can be sure that the ground before the driver's cabin is monitored and clear, i.e. free from any persons or objects, and he can be sure that there is no collision danger because this area is monitored by the auxiliary person.

Such an aerial system extends the operational range of the ladder into areas that cannot be monitored by the operator at the operator stand. This operator stand can be controlled by a main operator stand located at the ladder, or by relay to an auxiliary operator stand that can be located in a cage at the end of the ladder, or by rely to any other operator stand located elsewhere.

According to preferred embodiment of the present invention, the confirmation means comprise a push button. This button must be pushed to activate the control means at the operator stand at the ladder.

According to another embodiment, the confirmation means comprise a dead man button. Such a button must be held in its pushed state to be operated, and consequently the control means is activated only as long as the dead man button is held in this pushed state.

According to another preferred embodiment of the present invention, the control means comprises a start button to initiate an automatic move sequence previously stored in a storage means within and in electrical communication with the control means, to be automatically performed by the ladder, wherein the function of the start button is blocked when the confirmation means is not operated, and released when the confirmation means are operated. Such a start button to initiate an automatic move sequence facilitates the ladder operation, which can be automatized to some extent. However, this automatic move sequence can be activated only if the confirmation means is operated.

Preferably, the main operator stand located at the ladder is controlled by an operator therein, and the control means form part of the main operator stand.

More preferably the main operator stand comprises activation means, in particular an activation button or an activation pedal, which releases the main control means to control the bending movement of the arm. This activation means adds an additional security feature located at the main operator stand. As long as the ladder operator operates the activation means, i.e. pushes the activation button or presses the activation pedal with his foot, the main control means for the ladder can be operated to perform the bending movement. A move sequence of the ladder can be aborted immediately when the activation means is released.

According to another embodiment, the activation means comprise a dead man button or a dead man pedal, which must be held in a pressed or pushed state all the time for releasing the main control means.

According to another embodiment of the present invention, the turntable ladder system comprises an auxiliary operator stand located at the end of the arm for operating the ladder, said auxiliary operator stand comprising auxiliary control means for controlling a movement of the arm. Such an auxiliary operator stand can be arranged, for example, within a cage that is mounted at the end of the arm. A person standing in this cage can take over the control of the ladder by inputting operation commands into the auxiliary operator stand.

According to another preferred embodiment, the confirmation means is operatively connected to the auxiliary control means such that the bending movement of the arm can be controlled by the auxiliary control means only in case the confirmation means is operated.

According to an alternative embodiment, the auxiliary control means is operatively disconnected from the main control means such that the auxiliary control means can be operated independent from the operation state of the confirmation means. This function makes sense because a person in the cage who is able to operate the auxiliary control means has a sufficient visibility of the area into which the end of the arm is moved, and a confirmation means for the auxiliary control means is not necessary for this reason.

More preferably, the auxiliary operator stand comprises activation means, in particular, an activation button or an activation pedal, to be operated for activating the auxiliary control means.

The present disclosure also discloses a method for operating an aerial system of the above kind, characterized by the step of operating the confirmation means at the front of or laterally at the driver's cabin manually for releasing the control means for controlling the bending movement of the arm in which the arm is bent downwardly to the ground in front of the driver's cabin of the vehicle, and a step of operating the control means for controlling the aforesaid bending movement of the arm.

More preferably, this method comprises the step of operating the activation means at the main operator stand to release the control means to control the bending movement of the arm.

BRIEF DESCRIPTION OF THE DRAWINGS

These and other aspects of the invention will be apparent from and elucidated with reference to the embodiment described hereinafter.

DETAILED DESCRIPTION OF THE INVENTION

Figure 1:
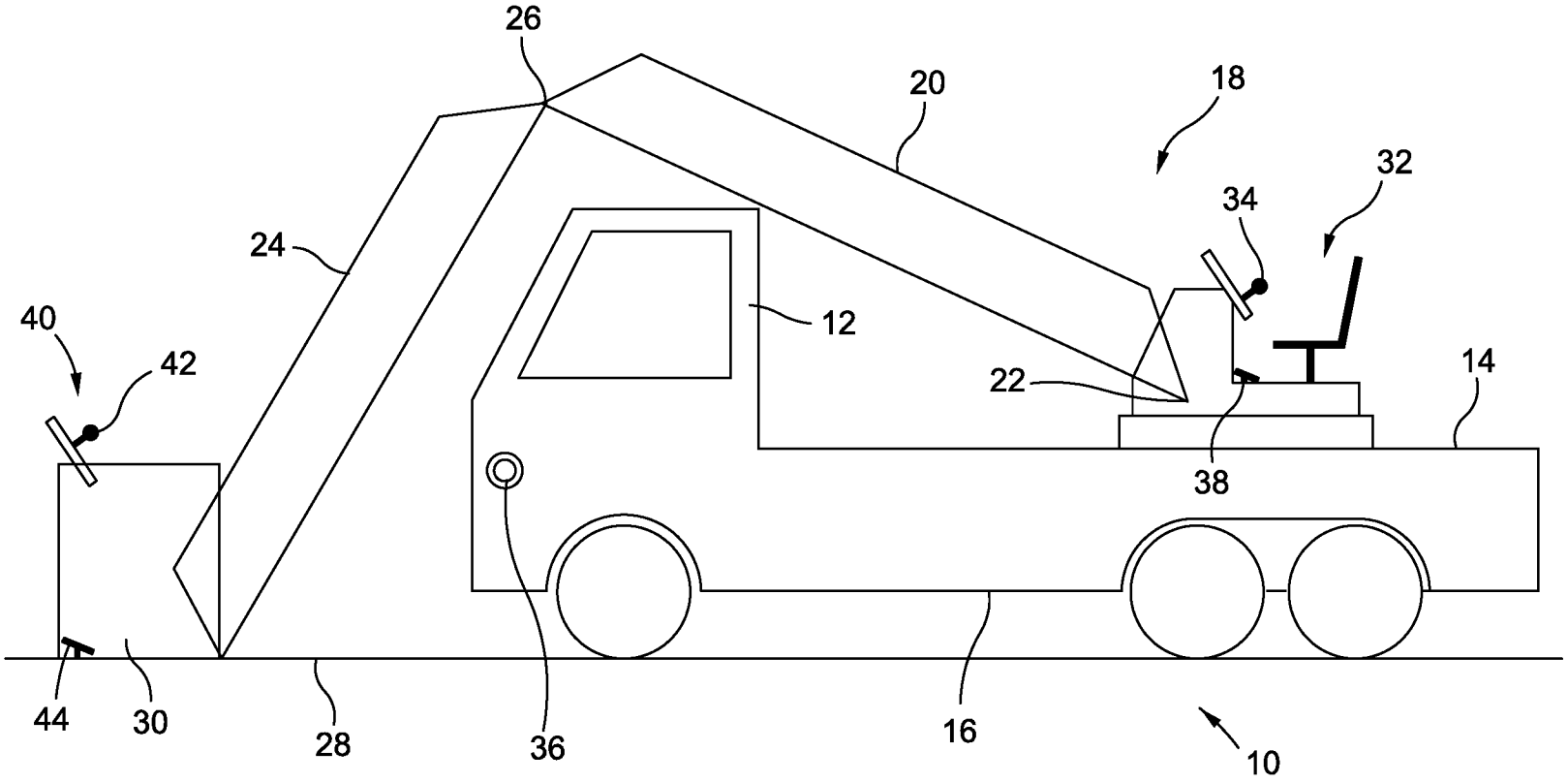
FIG. 1 is a schematic view of a fire fighting vehicle comprising an embodiment of the aerial system according to the present invention.

FIG. 1 shows a side view of a fire fighting vehicle 10, with the driver's cabin 12 on the left side of the figure. In the following the terms "front" and "rear" refer to the driving direction of the vehicle, i.e. the driver's cabin 12 is located at the front side. Behind the driver's cabin 12, a deck portion 14 is located on top of the rear part 16 of the vehicle. The deck portion 14 carries an aerial system, namely a turntable ladder system 18 comprising a turntable ladder 20. It is noted that the present invention can also be applied to other aerial systems with a telescopic ladder with a plurality of segments.

Figure 2:
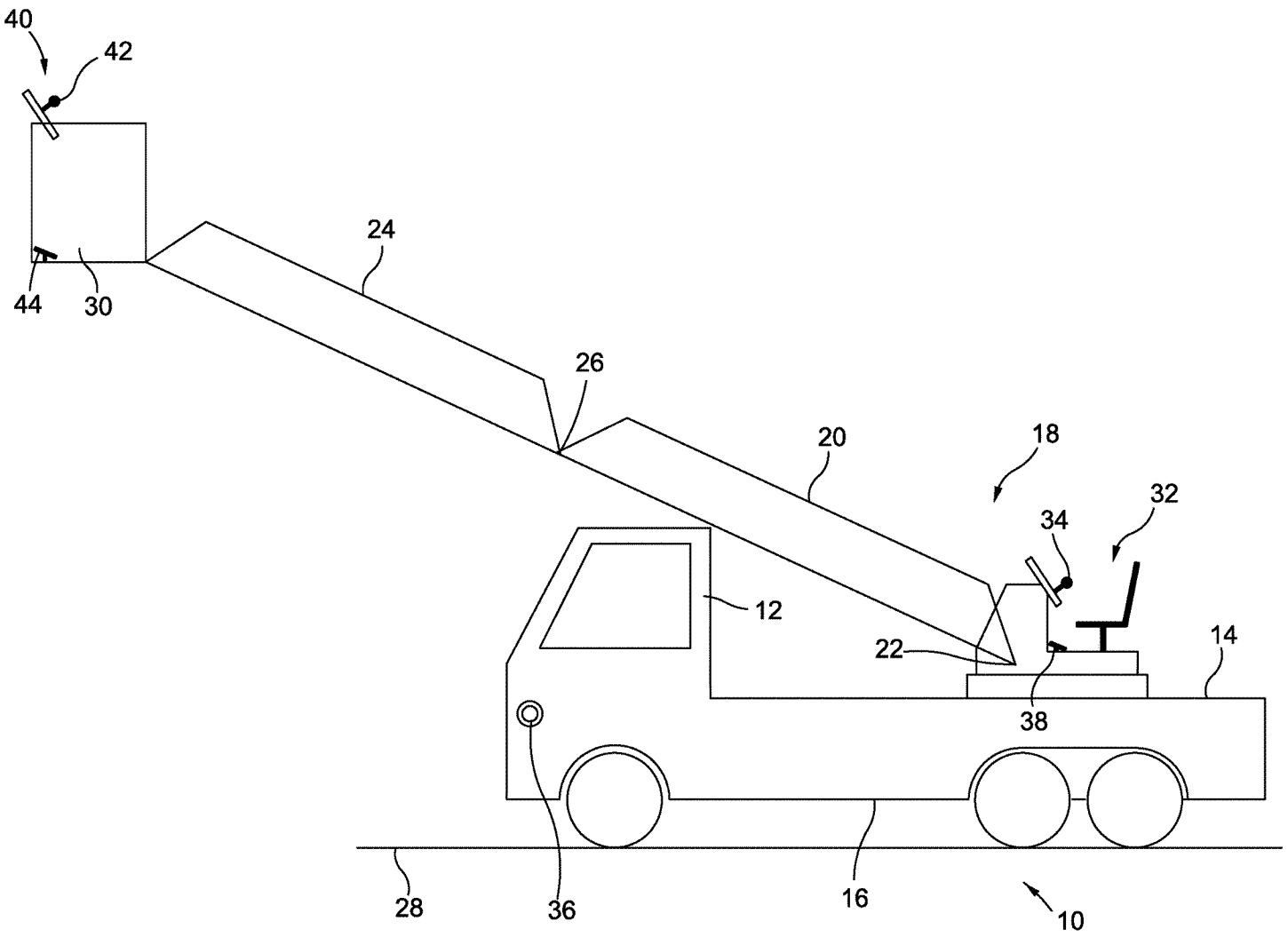
FIG. 2 shows a schematic view of a fire fighting vehicle with the aerial system extended and in linear alignment.

With reference to FIGS. 1 and 2, the turntable ladder 20 is rotatable around a vertical axis and can be articulated as a whole around a horizontal axis 22 near its vertical turning axis. The ladder 20 comprises a number of ladder segments that can be telescopically extended to extend the length of the ladder. FIG. 2 shows the ladder 20 with the arm 24 in a telescopically extended position. Returning to both FIGS. 1 and 2, a final ladder segment, an arm 24, is provided that can be bent around the horizontal axis 26 downwardly with respect to the ladder segment to which it is articulated. In the position shown in the figure, the turnable ladder 20 is turned into a position in which it extends over the roof of the driver's cabin 12 so that the articulated arm 24 can be bent downwardly in its extended position to the ground 28 in front of the driver's cabin 12. At the end of the arm 24, a cage 30 is mounted that can be entered from the ground 28 in the lowered position of the arm 24.

A main operator stand 32 for operating the turnable ladder 20 is located near the ladder 20. This main operator stand 32 comprises main control means 34 for controlling a movement of the ladder 20, i. e. the turning of the ladder 20 around its vertical axis, its extension, the articulation angle of the ladder 20 and in particular a bending movement of the arm 24, and other functions. This main operator stand 32 may comprise, for example, a display showing different functions, and the main control means 34 may comprise a joystick, for example.

An operator at the main operator stand 32 can control the ladder 20 such that the arm 24 can be bent downwardly when the arm is in the position shown in the figure so that the cage 30 at the end of the arm 24 is lowered down to the ground 28 in front of the driver's cabin 12. However, this bending movement cannot be monitored visually by the operator at the main operator stand 32, because the driver's cabin 12 blocks the view from the main operator stand 32 to the ground 28 in front of the driver's cabin 12, and it is not possible to monitor this movement to avoid collisions with objects or persons located on this ground area.

To enable safe operation of the turntable ladder system 18 in this situation, i.e. a safe bending movement to lower the arm 24 in front of the driver's cabin 12, a confirmation means 36 is located at the front portion of the driver's cabin 12. In the present embodiment the confirmation means 36 comprises a dead man button that can be pressed manually and must be held with a pressing force so as not to return into its released position. The confirmation means 36 is operatively connected to the main control means 34 such that bending movement can be controlled only if the confirmation means 36 is operated, i.e. the dead man button is held in its pressing position. As long as the dead man button is held in its depressed position, an input via the main control means 34 to initiate and to control the bending movement of the ladder 20 is possible. If the dead man button is released, an input of a control command into the main control means 34 for performing the bending movement is not possible, or at least the transfer of such commands towards said driving means of the ladder 20 is blocked. It is noted that performing operations other than performing the bending movement to lower the arm 24 in front of the driver's cabin 12 may be independent from the operation state of the confirmation means 36, so that it might still be possible to control the ladder's movement otherwise without the confirmation means 36 being operated.

In the situation described above, when it is intended to lower the arm 24 downwardly towards the ground area 28, a monitoring auxiliary person who stands in front or next to the driver's cabin 12 to monitor the ground area 28 is necessary. If the ground area 28 is clear, the auxiliary person confirms the absence of any collision danger by pressing the dead man button 36. This pressing operation can be confirmed by an acoustic or visual signal to the auxiliary person. At the same time, the operator at the main operator stand 32 also gets a confirmation signal to confirm that the main control means 34 is activated so that input commands to perform the bending movement can be input at the main operator stand 32 and transferred to the ladder 20. In this situation the operator can operate the ladder 20 to bend the arm 24 downwardly towards the ground 28 even if he cannot monitor this area, because this monitoring activity is taken over by the auxiliary person. In the event that danger arises during this articulating movement, the auxiliary person may release the dead man button 36 to deactivate the main control means 34 and to abort the movement.

Not every movement of the ladder 20 must necessarily be controlled by means of an operator operating the main control means 34. There is also the option that an automatic move sequence of the ladder 20 for performing the aforesaid bending movement is previously stored in a suitable storage means within the main control means 34, and this automatic move sequence is initiated by pressing a start button comprised within the main control means 34. After pressing the start button, the bending movement of the ladder 20 is performed automatically. The function of this start button is also blocked when the confirmation means 36 is not operated, and released when the confirmation means 36 is operated. In case the dead man button of the confirmation means 36 is released during the automatic move sequence, this move sequence is automatically stopped and aborted.

As another security feature, the main operator stand 32 comprises an activation means in form of an activation pedal 38. This activation pedal 38 must be held pressed for releasing the main control means 34 so that the bending movement to lower the arm 24 in front of the driver's cabin 12 can be performed. It can also be provided as a dead man pedal. If the activation pedal 38 is operated, an input of bending movement commands via the main control means 34 is possible. In an emergency situation the operator at the main operator stand 32 may release the activation pedal 38 immediately to stop the bending movement of the ladder 20 to prevent an accident. In the present embodiment comprising the confirmation means 36 at the driver's cabin 12 and the activation pedal 38 at the main operator stand 32, there are two independent security features to confirm an input of control commands via the main control means 32 concerning the bending movement. Both the confirmation means 36 and the activation pedal 38 must be operated to activate the main control means 34. Optionally, the activation means located in the main operator stand 34 may also comprise a dead man button.

Within the cage 30, an auxiliary operator stand 40 is located that comprises auxiliary control means 42 for controlling a movement of the arm. By means of this auxiliary operator stand 40, a person located within the cage 30 can control the arm 24 and its articulating movement to be lowered to the ground 28. These auxiliary control means 42 can be operatively disconnected from the main control means 34 such that the auxiliary control means 42 can be operated independent from the operation state of the confirmation means 36. This means that if the ladder 20 is operated from the cage 30 by means of the auxiliary control means 42, no confirmation via the confirmation means 36 is necessary, because a person located within the cage 30 can monitor the ground 28 himself, without the need of any auxiliary person to confirm this movement. Alternatively the confirmation means 36 can be operatively connected to the auxiliary control means 42 such that the bending movement of the arm 24 can be controlled by the auxiliary control means 42 only in case the confirmation means 36 are operated.

The auxiliary operator stand 40 within the cage 30 may also comprise other activation means, in particular an activation button or an activation pedal 44, that must be held pressed or pushed for activating the auxiliary control means 42. If this activation pedal 44 is released, an input of movement commands via the auxiliary control means 42 can be blocked to abort a moving sequence immediately.

What is claimed is:

1. A rescue vehicle comprising:

a telescopic ladder mounted on top of a turntable and comprising a ladder portion proximal to the turntable and a distal ladder portion telescopically extendable to a position distal to the ladder portion proximal to the turntable, the distal ladder portion being operable to perform, when the ladder portion proximal to the turntable is aligned over a driver's cabin of the rescue vehicle, a downwards articulation from a telescopically extended position with the ladder portion proximal to the turntable, such that at least a portion of the ladder portion distal to the turntable is lowered to occupy space in frontal alignment with the driver's cabin;

at least one control for operating the ladder;

the driver's cabin located forward of the turntable;

at least one actuatable confirmation button located on an outside side panel of the driver's cabin of the rescue vehicle which is positioned outside with respect to an inside of the driver's cabin; and wherein the confirmation button must be actuated to permit the at least one control to operate the ladder to perform, with the ladder portion proximal to the turntable aligned over the driver's cabin of the rescue vehicle, the downwards articulation from linear alignment with the ladder portion proximal to the turntable such that at least the portion of the ladder portion distal to the turntable is lowered to occupy space in frontal alignment with the driver's cabin.

2. The rescue vehicle of claim 1, wherein the confirmation button comprises a push button.

3. The rescue vehicle of claim 2, wherein the confirmation button comprises a deadman button.

4. The rescue vehicle of claim 1 further comprising non-transitory readable memory for storing pre-determined move sequences for later execution by the at least one control, wherein the at least one control is configured to initiate an automatic move sequence of the turntable ladder aerial system, the automatic move sequence being previously stored in the readable memory, wherein performance of the automatic move sequence is blocked when the confirmation button is not actuated, and not blocked when the confirmation button is actuated.

5. The rescue vehicle of claim 1 further comprising a main operator stand on the turntable, wherein the at least one control is located at the main operator stand.

6. The rescue vehicle of claim 5, further comprising an auxiliary operator stand at a distal end of the ladder portion distal to the turntable, wherein the at least one control further comprises an auxiliary control for operating the ladder, and the auxiliary control is located at the auxiliary operator stand.

7. The rescue vehicle of claim 6, wherein the auxiliary control is operatively disconnected from the confirmation button such that the auxiliary control operates the ladder to perform, when the ladder portion proximal to the turntable is aligned over the driver's cabin of the rescue vehicle, the downwards articulation from linear alignment with the ladder portion proximal to the turntable such that at least the portion of the ladder portion distal to the turntable is lowered to occupy space in frontal alignment with the driver's cabin, bypassing the confirmation button.

8. The rescue vehicle of claim 7, further comprising an actuatable auxiliary confirmation button, wherein the actuatable auxiliary confirmation button must be actuated to permit the auxiliary control to operate the ladder to perform, with the ladder portion proximal to the turntable aligned over the driver's cabin of the rescue vehicle, the downwards articulation from linear alignment with the ladder portion proximal to the turntable such that at least the portion of the ladder portion distal to the turntable is lowered to occupy space in frontal alignment with the driver's cabin.

9. The rescue vehicle of claim 1, wherein the at least one control and the confirmation button are spaced far enough apart to prevent direct operation of both the main control and the confirmation button by a single user.

* * * * *